US007051466B1

(12) United States Patent
Barnes

(10) Patent No.: US 7,051,466 B1
(45) Date of Patent: May 30, 2006

(54) BREAKAWAY SIGN POST WITH MAGNETICALLY COUPLED SECTIONS

(76) Inventor: Theodore D. Barnes, 4829 S. Tierney Dr., Independence, MO (US) 64055

( * ) Notice: Subject to any disclaimer, the term of this patent is extended or adjusted under 35 U.S.C. 154(b) by 0 days.

(21) Appl. No.: 10/997,133

(22) Filed: Nov. 24, 2004

(51) Int. Cl.
*G09F 7/04* (2006.01)

(52) U.S. Cl. ..... 40/600; 40/607.04

(58) Field of Classification Search ..... 40/600, 40/607.01, 607.04, 607.05, 607.1, 608
See application file for complete search history.

(56) References Cited

U.S. PATENT DOCUMENTS

| | | | | |
|---|---|---|---|---|
| 3,349,531 | A | 10/1967 | Watson | |
| 3,820,906 | A | 6/1974 | Katt | |
| 3,846,030 | A | 11/1974 | Katt | |
| 4,171,919 | A * | 10/1979 | Willis | 403/11 |
| 4,236,843 | A * | 12/1980 | Chisholm | 403/2 |
| 4,490,062 | A | 12/1984 | Chisholm | |
| 4,619,456 | A * | 10/1986 | Meggs | 473/471 |
| 4,926,592 | A | 5/1990 | Nehls | |
| 4,928,446 | A | 5/1990 | Alexander, Sr. | |
| 5,039,100 | A * | 8/1991 | Cortese | 273/127 B |
| 5,088,683 | A | 2/1992 | Briden | |
| 5,160,111 | A | 11/1992 | Hugron | |
| 5,214,886 | A | 6/1993 | Hugron | |
| 5,340,065 | A * | 8/1994 | Thomas | 248/150 |
| 5,480,121 | A | 1/1996 | Rice et al. | |
| 5,484,217 | A | 1/1996 | Carroll et al. | |
| 5,535,555 | A | 7/1996 | Boyd et al. | |
| 5,782,040 | A | 7/1998 | McCartan | |
| 5,895,169 | A * | 4/1999 | Holm et al. | 404/9 |
| 5,988,598 | A | 11/1999 | Sicking et al. | |
| 6,264,162 | B1 | 7/2001 | Barnés et al. | |
| 6,390,436 | B1 * | 5/2002 | Barnes et al. | 248/548 |
| 6,422,783 | B1 * | 7/2002 | Jordan | 404/9 |
| 6,540,196 | B1 * | 4/2003 | Ellsworth | 248/548 |
| 6,739,567 | B1 * | 5/2004 | Curtis | 248/548 |

* cited by examiner

*Primary Examiner*—Gary C. Hoge
(74) *Attorney, Agent, or Firm*—Hovey Williams LLP

(57) ABSTRACT

An improved sign post assembly (10) for roadway use is provided wherein a sign post (12) includes a lower section (16) adapted for anchoring to the earth, a mating upper section (20) and a magnetic coupling assembly (24) for maintaining the sections during normal use while permitting breakaway of the upper section (20) when the host (10) is struck by a vehicle. Preferably, the coupling assembly (24) includes a magnetic body (26) and a corresponding component (28) which is magnetically attracted to the body (26). In order to cause breakaway in a predetermined direction, the coupling assembly (24) has mating surfaces for the body (26) and component (28) which are in a stairstep configuration.

30 Claims, 2 Drawing Sheets

BREAKAWAY SIGN POST WITH MAGNETICALLY COUPLED SECTIONS

BACKGROUND OF THE INVENTION

1. Field of the Invention

The present invention is broadly concerned with improved breakaway sign posts which can be used to support various types of signs in roadway environments. More particularly, the invention is concerned with such sign posts, as well as the coupling assemblies used to interconnect upper and lower sign post sections, wherein a magnetic coupling arrangement is employed in lieu of complex and costly mechanical couplers.

2. Description of the Prior Art

Posts of many different varieties are used in association with roadways. Such posts may be employed to support signs, providing information to vehicle operators, and barriers, directing vehicles away from hazardous areas. Most posts along a roadway are fixed to the ground by digging a post hole, inserting the base of the post into the hole and then filling the hole with concrete or other material to support the post.

Such roadway posts are often inadvertently hit by vehicles traversing the roadways, which usually result in breaking of the posts. When a post breaks, the top portion thereof can rotate toward the vehicle and possibly enter the vehicle's passenger compartment. This can result in serious or even fatal injuries to the occupants.

A further problem with roadway posts currently in use is the difficulty in replacing the post once it has been broken. To reinstall a damaged post, the original concrete must be dug up and removed. Then, a new post is inserted into the hole and fresh concrete is poured to fix it in place. This is labor intensive and requires several man-hours of labor for each broken post.

Breakaway posts have been devised in the past for use in supporting signs, while providing a breakaway function during a sudden vehicle impact. For example, U.S. Pat. No. 6,264,162 describes a successful design of this character. This breakaway post assembly includes a specialized breakaway collar having strategically located lines of weakness which yields during a vehicle impact. Additional breakaway post designs are described in the following U.S. Pat. Nos. 5,480,121, 3,349,531, 3,820,960, 3,846,030, 4,490,062, 4,926,592, 4,928,446, 5,088,683, 5,160,111, 5,214,886, 5,484,217, 5,535,555, 5,782,040, and 5,988,598.

These prior art breakaway posts are all characterized by mechanical connection structure between upper and lower separate post sections. While providing a useful breakaway function, once impacted by a vehicle, it is necessary to reinstall the collar or related structure to put the post back into an operative condition. Moreover, in certain of the prior designs, it is impossible to repair the breakaway post, and a new installation is necessary. In other instances, the prior breakaway posts do not break away in any predetermined fashion or direction, i.e., it is possible that the broken away portion may fall toward the vehicle rather than away from it.

There is accordingly a real and unsatisfied need in the art for an improved breakaway post assembly which avoids complex mechanical collar arrangements and permits easy repair of a post after it has broken away, and which is designed to cause the broken away post section to fall in a predetermined direction away from the impacting vehicle.

SUMMARY OF THE INVENTION

The present invention overcomes the problems outlined above and provides an improved breakaway sign post which is preferably fabricated so as to break away in a predetermined direction to enhance safety, and which makes use of a magnetic coupling assembly between the post sections which is effective to hold the section in place during normal use while giving the necessary breakaway feature when the post is struck by a vehicle. Additionally, the sign post assembly of the invention can be readily repaired in the field without the need for extensive time or labor.

Broadly speaking, the sign post includes a first or lower section adapted to be anchored to the earth, as well as a second or upper mating section. A magnetic coupling assembly is used to operably couple the sections together while permitting breakaway; the coupling assembly includes a magnetic body carried by one of the sections and a component carried by the other of the sections which is magnetically attracted to the body.

In preferred forms, the component and body are designed for face-to-face contact and include complemental stairstep-type contact surfaces which enhance the tendency for breakaway in a predetermined fashion. The body and component may be integrally formed with the associated post sections, or separately fabricated and attached thereto.

DETAILED DESCRIPTION OF THE PREFERRED EMBODIMENT

Figure 1:
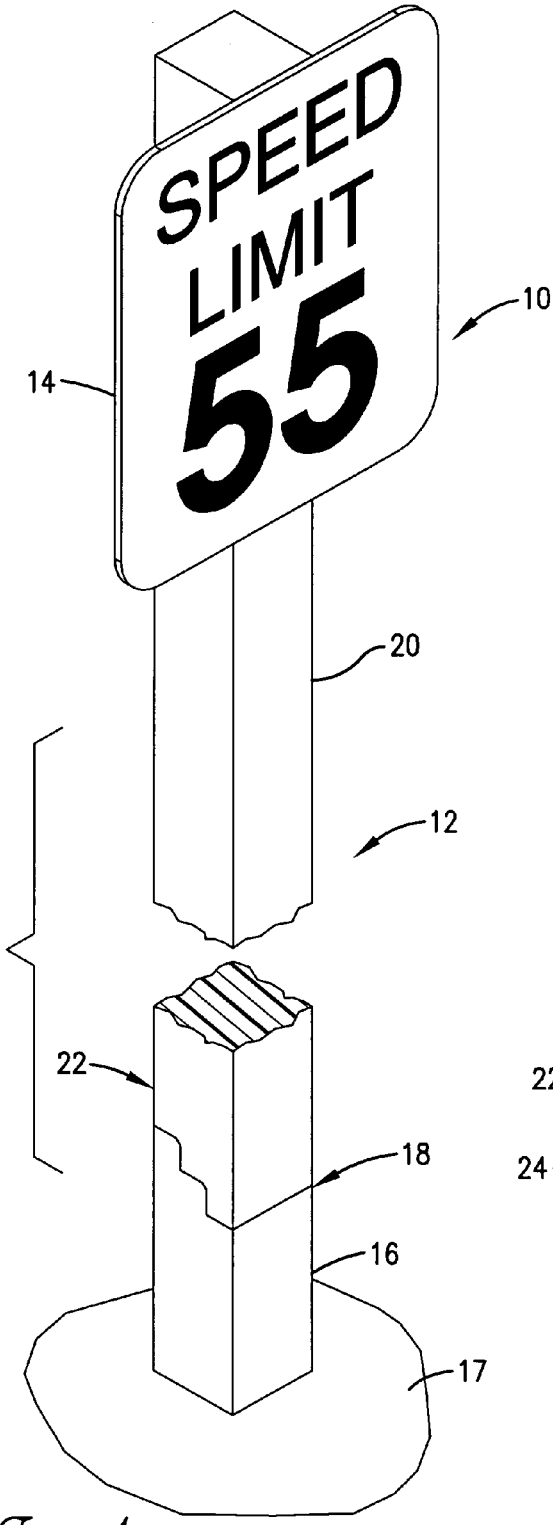
FIG. 1 is a fragmentary perspective view of a breakaway sign post in accordance with the invention, equipped with a magnetic coupling assembly.

Turning now to the drawings, and particularly FIG. 1, a sign post assembly 10 in accordance with the invention is illustrated. Broadly speaking, the sign post 10 includes an upright breakaway sign post 12 supporting a sign 14. The post 12 has a lower section 16 adapted to be anchored to the earth (usually by burying the lower end in concrete fill 17) and presenting an upper end 18, as well as an upper section 20 presenting a lower end 22. A magnetic coupling assembly 24 is used to operably couple the lower end 22 of section 20 to the upper end 18 of section 16, while permitting breakaway of the section 20 relative to the section 16 in the event of application of sufficient force against the section 20. In general, the assembly 24 includes a magnetic body 26 carried by one of the sections (in the illustrated embodiment, by lower section 16), and a component 28 carried by the other section (here, upper section 20), with the component being magnetically attracted to the body 26. As will be readily appreciated, the magnetic body 26 may be a permanent magnet, while the component 28 may be an opposite-pole permanent magnet or formed from a ferromagnetic or other metallic or nonmetallic material which has an appropriate degree of magnetic susceptibility.

Figure 2:
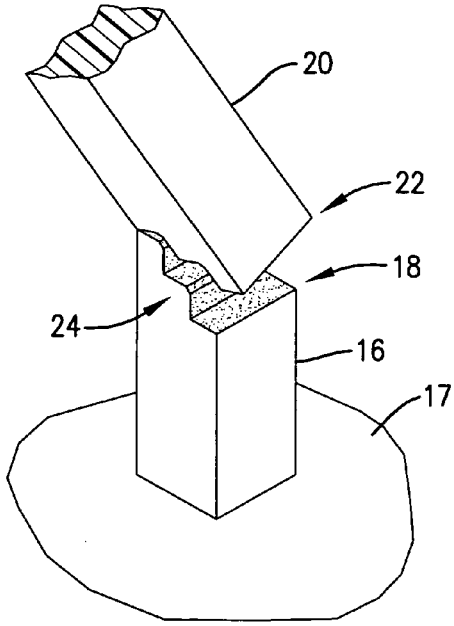
FIG. 2 is a fragmentary view illustrating the breakaway function of the post illustrated in FIG. 1.
Figure 3:
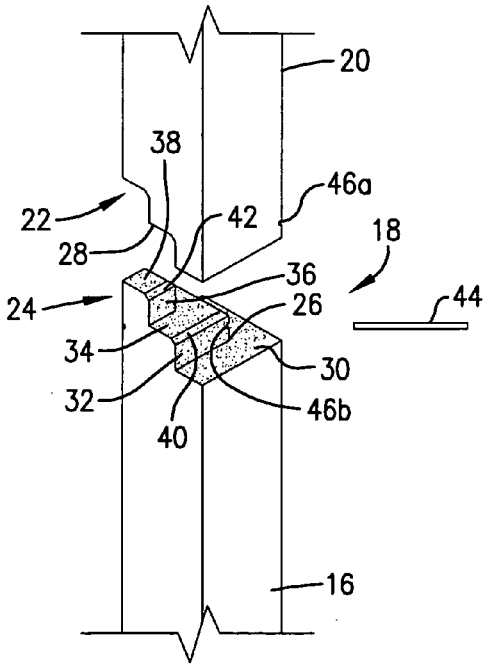
FIG. 3 is an exploded view of the magnetic coupling assembly in the FIG. 1 design.

In preferred forms, the coupling assembly 24 is configured to cause the upper section 20 to break away from the section 16 in a predetermined direction; in the case of the FIG. 1 arrangement, the section 20 would have the tendency to break away in the direction shown in FIG. 2, or rearwardly and leftwardly. There are a number of different embodiments for the assembly 24 which will yield acceptable results. The embodiment of FIGS. 1–3 has the body 26 and component 28 integrally formed with the corresponding sections 16 and 20. In greater detail, it will be seen that the magnetic material making up the body 26 is formed to have a stairstep-type contact surface, presenting a lowermost, generally L-shaped contact surface 30, a first vertical riser surface 32, an intermediate, smaller, generally L-shaped contact surface 34, a second vertical riser surface 36 and finally an uppermost generally square contact surface 38. It will be observed that the surface areas of the contact surfaces 30, 34 and 38 are progressively smaller, and that the junctures between the first riser surface 32 and intermediate surface 34, and between second riser surface 36 and uppermost surface 38, are beveled as at 40, 42. Preferably, the lower surface of component 28 is completely complemental with the above-described surface of body 26, so that the component and body are in full face-to-face engagement throughout. In order to prevent inadvertent breakaway of the section 22 during high wind conditions or through the action of vandals, a shear pin 44 is provided which extends between the body 26 and component 28. As illustrated in FIG. 3, an obliquely oriented through-bore 46*a* is provided through the body 26, with a mating bore 46*b* provided through the component 28. When the body and component are intercoupled as shown in FIG. 1, the bores 46*a*, 46*b* are in alignment, and shear pin 44 is inserted therein.

When the sign post 10 is struck by a vehicle, the upper section 20 breaks away as shown in FIG. 2. By virtue of the specialized configuration of the coupling assembly 24, such break away occurs rearwardly and leftwardly as previously described. The stairstep configuration of the body 26 and component 28 ensure that this occurs, with the second riser surface 36 and uppermost contact surface 38 effectively forming a fulcrum as shown.

Figure 4:
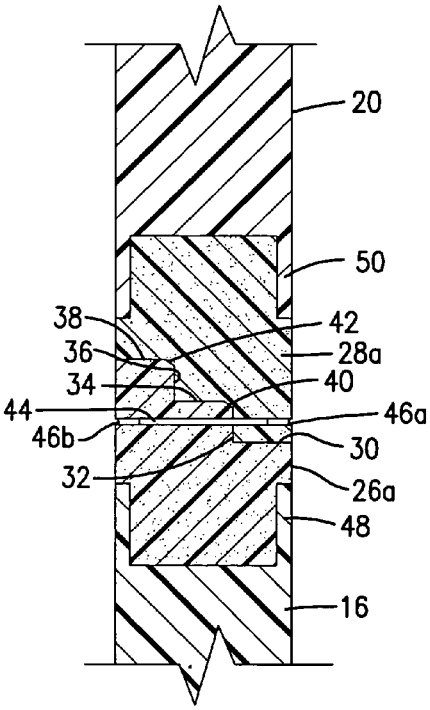
FIG. 4 is a fragmentary vertical sectional view of another breakaway post embodiment, wherein the parts of the magnetic coupler are secured to the adjacent end of upper and lower post sections.
Figure 5:
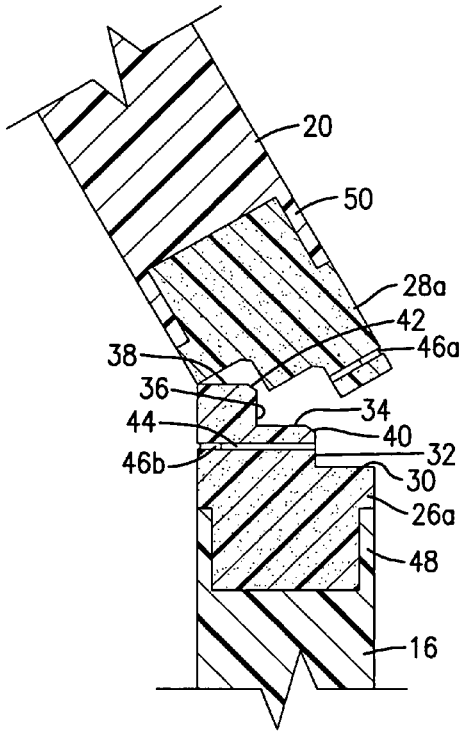
FIG. 5 is a view similar to that of FIG. 4 but illustrating the breakaway function of the magnetic coupling assembly.

FIGS. 4–5 depict a further embodiment in accordance with the invention. In this case the lower section 16 is configured to present an upstanding, cup-like retainer wall 48 while the upper section 20 has a similar, downwardly extending retainer wall 50. The magnetic body 26*a*, and the component 28*a*, are respectively seated within the walls 48 and 50, and present the same stairstep-type contact surfaces and shear pin arrangement as described with reference to the earlier embodiment. Accordingly, the same reference numbers have been applied to this structure. It will be appreciated, however, that the principal difference between this embodiment and that of FIGS. 1–3 is that the body 26*a* and component 28*a* are not integral with the associated sections, but rather are seated within the walls 48, 50 and affixed therein by adhesive or other means. Similarly, the breakaway action of this embodiment is the same as that described previously; however, FIG. 5 further depicts the shearing of pin 44 during the breakaway sequence.

Figure 6:
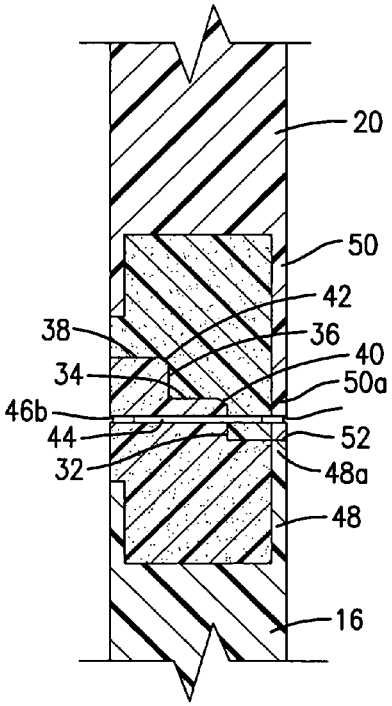
FIG. 6 is a fragmentary vertical section similar to that of FIG. 4, but depicting a still further embodiment wherein the forward margin of the coupling assembly is equipped with a non-magnetic area to ensure that the upper post section falls in a predetermined fashion when impacted.

FIG. 6 illustrates a still further embodiment relating to the assembly 24. In this case the retainer walls 48 and 50 associated with the sections 16 and 20 have forward extensions 48*a* and 50*a* along the portion of the walls remote from contact surface 38. In this fashion the butt ends of the wall sections 48*a*, 50*a* come into close adjacency and contact as at 52, thereby creating a region or area which is nonmagnetic. This design further enhances the tendency of the upper section 26 to break away in a predetermined manner, because of the lack of any magnetic attraction along the front edge of the assembly 24. In all other respects, the embodiment of FIG. 6 is identical with that of FIGS. 4–5.

Figure 7:
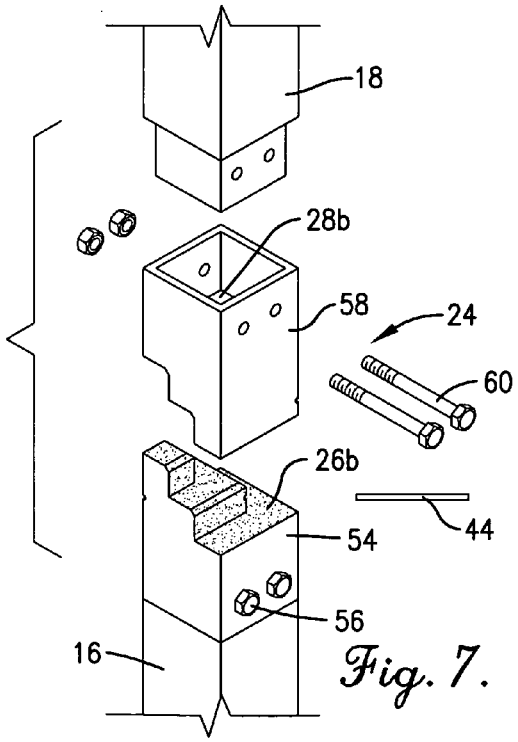
FIG. 7 is an exploded view of another embodiment wherein the parts of the magnetic coupling assembly are mechanically affixed by fasteners to the upper and lower post sections.

FIG. 7 shows yet another embodiment of the invention. In this case the lower section 16 is equipped with an upstanding tubular bracket 54 which is affixed to the section 16 by bolts 56. The bracket 54 houses the body 26*b* which again presents the same preferred contact surface arrangement described previously. In like manner, the upper section 18 has a downwardly extending tubular bracket 58 affixed thereto by bolts 60. The component 28*b* is housed and supported by the bracket 54, and is again complemental with the body 26*b*. The operation of this embodiment is identical with that of the previous embodiment.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

I claim:

1. A breakaway sign post, comprising:

a first sign post section adapted to be anchored to the earth and presenting an upper end;

a second sign post section including a lower end; and a magnetic coupling assembly operably coupling said second section lower end to said first section upper end and permitting breakaway of the second section relative to the first section in event of application of sufficient force against the second section, said assembly including a magnetic body carried by one of said sections, and a component which is magnetically attracted to said body carried by the other of said sections, said coupling assembly including a shear pin associated with said body and said component and operable to shear in the event of said application of force.

2. The sign post of claim 1, said coupling assembly configured to cause said second section to break away from said first section in a predetermined direction.

3. The sign post of claim 1, said body and component configured for face-to-face engagement.

4. The sign post of claim 3, said body and component having complemental surfaces.

5. The sign post of claim 3, said body comprising a permanent magnet, and said component selected from the group consisting of another permanent magnet and a metallic body which is attracted to said body.

6. The sign post of claim 3, said magnetic body being integrally formed with one of said first and second sections.

7. The sign post of claim 1, said component being integrally formed with one of said first and second sections.

8. The sign post of claim 1, said body being separate from and connected to one of said sections.

9. The sign post of claim 1, said component being separate from and connected to one of said sections.

10. The sign post of claim 1, said coupling assembly comprising a pair of tubular brackets respectively connected to said upper end and said lower end, one of said brackets supporting said body and the other of said brackets supporting said component.

11. The sign post of claim 1, said assembly having elongated, mating surfaces adjacent said body and said component and forming a non-magnetic zone along the length thereof.

12. A breakaway sign post, comprising:

a first sign post section adapted to be anchored to the earth and presenting an upper end;

a second sign post section including a lower end; and a magnetic coupling assembly operably coupling said second section lower end to said first section upper end and permitting breakaway of the second section relative to the first section in event of application of sufficient force against the second section, said assembly including a magnetic body carried by one of said sections, and a component which is magnetically attracted to said body carried by the other of said sections, said body and component configured for face-to-face engagement, one of said body and said component presenting a stairstep configuration including upper and lower vertically spaced apart, generally horizontal contact surfaces and an upright riser contact surface extending between the upper and lower contact surfaces.

13. The sign post of claim 12, said upper contact surface having a surface area less than the surface area of the adjacent lower contact surface.

14. The sign post of claim 12, the region adjacent the intersection of said riser surface and said upper contact surface being beveled.

15. The sign post of claim 12, there being a lower, intermediate and upper vertically spaced apart, generally horizontal contact surfaces, and a pair of riser surfaces respectively extending between the lower surface and intermediate surface, and between the intermediate surface and the upper surface.

16. The sign post of claim 15, the surface area of said upper surface being less than the surface area of said intermediate surface, and the surface area of said intermediate surface being less than the surface area of said lower surface.

17. The sign post of claim 12, said horizontal contact surfaces being generally L-shaped in plan configuration.

18. A magnetic coupling assembly adapted for interconnecting first and second sign post sections, said coupling assembly comprising a pair of tubular brackets respectively adapted for connection to the first and second sections, one of said brackets supporting a magnetic body, and the other of said brackets supporting a component magnetically attracted to said body, said coupling assembly operable to magnetically couple the first and second sections and permitting breakaway of one of the sections relative to the other section, said coupling assembly including a shear pin associated with said body and said component.

19. The coupling assembly of claim 18, said brackets configured to cause breakaway of said one section relative to said other section in a predetermined direction.

20. The coupling assembly of claim 18, said body and component configured for face-to-face engagement.

21. The coupling assembly of claim 20, said body and component having complemental surfaces.

22. The coupling assembly of claim 18, said body comprising a permanent magnet, and said component selected from the group consisting of another permanent magnet and a metallic body which is attracted to said body.

23. The coupling assembly of claim 18, said magnetic body being integrally formed with one of said brackets.

24. The coupling assembly of claim 18, said component being integrally formed with one of said brackets.

25. A magnetic coupling assemble adapted for interconnecting first and second sign post sections, said coupling assembly comprising a pair of tubular brackets respectively adapted for connection to the first and second sections, one of said brackets supporting a magnetic body, and the other of said brackets supporting a component magnetically attracted to said body, said coupling assembly operable to magnetically couple the first and second sections and permitting breakaway of one of the sections relative to the other section, said body and component configured for face-to-face engagement, one of said body and said component presenting a stairstep configuration including upper and lower vertically spaced apart, generally horizontal contact surfaces and an upright riser contact surface extending between the upper and lower contact surfaces.

26. The coupling assembly of claim 25, said upper contact surface having a surface area less than the surface area of the adjacent lower contact surface.

27. The coupling assembly of claim 25, the region adjacent the intersection of said riser surface and said upper contact surface being beveled.

28. The coupling assembly of claim 25, there being a lower, intermediate and upper vertically spaced apart, generally horizontal contact surfaces, and a pair of riser surfaces respectively extending between the lower surface and intermediate surface, and between the intermediate surface and the upper surface.

29. The coupling assembly of claim 28, the surface area of said upper surface being less than the surface area of said intermediate surface, and the surface area of said intermediate surface being less than the surface area of said lower surface.

30. The coupling assembly of claim 25, said horizontal contact surfaces being generally L-shaped in plan configuration.

* * * * *